US007451714B1

(12) United States Patent
Redfern et al.

(10) Patent No.: US 7,451,714 B1
(45) Date of Patent: Nov. 18, 2008

(54) ALL PURPOSE SEAL

(75) Inventors: Robert Redfern, Media, PA (US); Constantine Pappas, Philadelphia, PA (US); Luke Cassario, Waterford, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 72 days.

(21) Appl. No.: 11/586,748

(22) Filed: Oct. 4, 2006

(51) Int. Cl.
*B63B 19/00* (2006.01)
*E06B 7/16* (2006.01)

(52) U.S. Cl. ..... 114/117; 49/483.1

(58) Field of Classification Search ..... 114/117
See application file for complete search history.

(56) References Cited

U.S. PATENT DOCUMENTS 5,216,840 A * 6/1993 Andrews ..... 49/483.1
5,553,871 A 9/1996 Rowe et al.
6,799,396 B1 10/2004 Redfern et al.
6,879,256 B1 4/2005 Redfern et al.

* cited by examiner

*Primary Examiner*—Jesús D Sotelo
(74) *Attorney, Agent, or Firm*—Dave A. Ghatt

(57) ABSTRACT

An apparatus for sealing a doorway, more particularly, an all purpose gasket structure capable of sealing a doorway against the entry of water, smoke, and fire. The gasket is primarily an elongated silicone rubber structure having a ridged rectangular cross section for mounting to a gasket retainer. The gasket also includes a crush zone which collapses inwardly when pressure is applied to the gasket surface, resulting in improved sealing and the blockage of water intrusion paths. The gasket may further include an intumescent section within the elongated silicone rubber structure. In the sealing arrangement, the gasket is arranged within a gasket retainer that surrounds the doorway, thereby sealing boundaries between areas of personal egress.

15 Claims, 3 Drawing Sheets

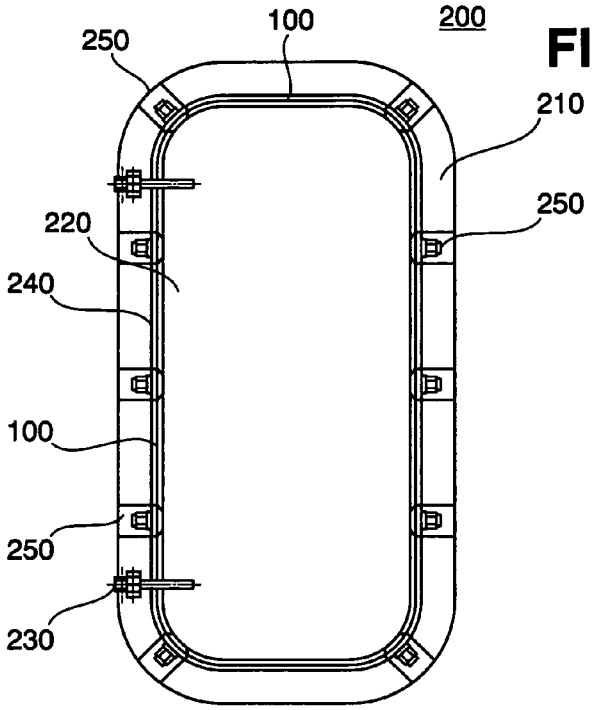
FIG. 2A
FIG. 2B
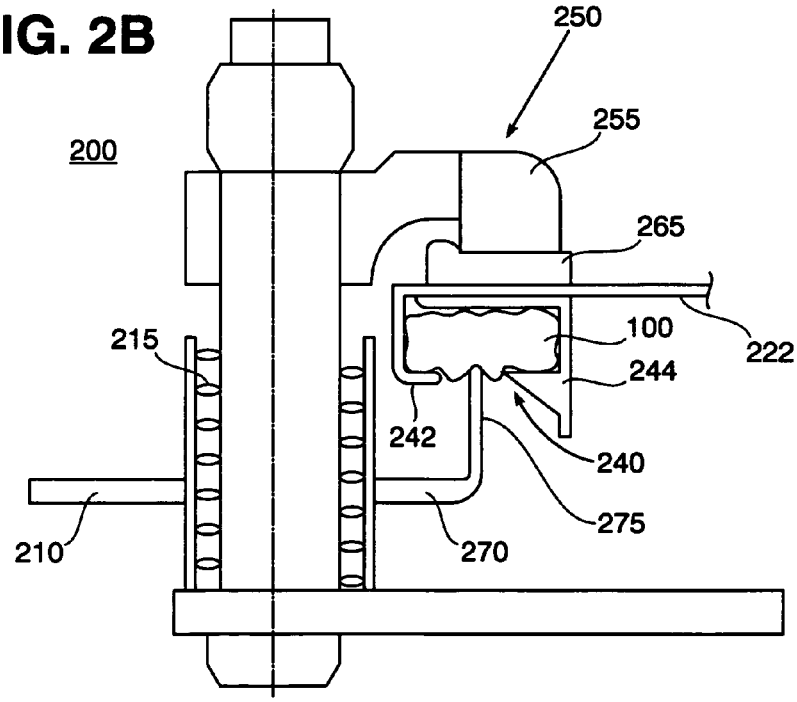

ALL PURPOSE SEAL

STATEMENT OF GOVERNMENT INTEREST

The invention described herein may be manufactured and used by or for the Government of the United States of America for governmental purposes without the payment of any royalties thereon or therefore.

FIELD OF THE INVENTION

The present invention relates generally to an apparatus for sealing a doorway, more particularly, the present invention relates to a gasket structure capable of sealing a doorway against the entry of water, smoke, and fire.

BACKGROUND OF THE INVENTION

U.S. Navy watertight arrangements are utilized in watertight boundaries where personnel egress through bulkheads is needed but watertight integrity must be maintained. The sealing mechanism of standard watertight door arrangements comprise a series of dogs sliding across ramped wedges, which are connected to the door panel. The sliding of the dogs across the wedges pulls the panels into a knife edge associated with the door. Navy protocol requires that the knife edge must compress the gasket to one-eight of an inch in order for the door system to be deemed watertight.

Until the 1990s, the Navy used primarily three types of gaskets in watertight arrangements: Military Specification Mil-R-900 (rubber gasket material); Federal Specification ZZ-R-765 (silicone rubber, Class 2b Grade 40); and, Military Specification Mil-G-17927 (gaskets, glass-metallic cover with silicone core). The Military Specification Mil-R-900 gaskets were designed with a generally rectangular cross section in which two edges were chamfered. These gaskets had a high durometer rating, requiring excessive dogging forces needed to correctly seal the door. These high dogging forces resulted in accelerated wear on watertight door components, requiring extensive adjustment and replacement of door components such as wedges and linkage bearings. Additionally, these gaskets were difficult to install and even more difficult to remove.

The type ZZ-R-765 gaskets were typically used in watertight doors in missile blast areas. The ZZ-R-765 gaskets were also designed with a generally rectangular cross section in which two edges were chamfered. These gaskets had a generally low durometer rating, and were mid-range with respect to costs. For watertight applications, the ZZ-R-765 gaskets were relatively easy to install and remove.

The type Mil-G-17927 gaskets had a silicone core and two additional layers of glass metallic-cloth, topped by a silicone rubber coating. The Mil-G-17927 gaskets had a generally rectangular cross section. These gaskets had a high durometer rating and were extremely expensive to procure.

If fire and smoke protection are required in addition to water protection, then the gaskets must be able to withstand temperatures of about 2000 degrees Fahrenheit and maintain their fire, smoke, and water sealing integrity. Of the three gaskets types named above, the ZZ-R-765 Class 2B Grade 40 performed best, however there was still a need for improvement. In light of this need, a new watertight door gasket, outlined in U.S. Pat. No. 5,553,871, was developed using Federal Specification ZZ-R-765 as the material requirement. Eventually, this Federal Specification became obsolete and was replaced by Commercial Item Description A-A-59588. This new gasket had an altered profile with a generally rectangular cross section with chamfered edges, and a semicircular cut-out portion along a surface. This design allowed for easier dogging of watertight door panels and improved fire and smoke protection. However, this gasket design still failed to properly seal exits when exposed to fires of about 1,500 to 2,000 degrees Fahrenheit for prolonged periods of time. Consequently, there is still a need for a seal with a design that protects against the entry of fire, smoke, and water, especially when exposed to fires of from about 1,500 degrees Fahrenheit to 2,000 degrees Fahrenheit and higher.

SUMMARY OF THE INVENTION

The present invention addresses aspects of problems outlined above. Preferred embodiments of the present invention provide an apparatus for sealing a doorway against the entry of water, smoke, and fire.

In one aspect, the invention is a gasket with an elongated silicone rubber member having a ridged rectangular cross-section for mounting to a gasket retainer and a door frame. The ridged rectangular cross-section has a back side with a first end and a second end and a front side with a first end and a second end. The ridged rectangular cross-section also has a first side extending from the first end of the back side to the first end of the front side and a second side extending from the second end of the back side to the second end of the front end. The ridged rectangular cross section further has a ridged portion protruding from the front side, wherein the back side, the front side, the first side, and the second side are for contacting inner walls of the gasket retainer. The ridged portion is for contacting a knife edge of the door frame. In this aspect, the gasket further includes an elongated crush zone within the elongated silicone rubber member formed substantially adjacent to the ridged portion of the elongated silicone rubber member.

In another aspect, the invention is an all-purpose sealing arrangement. The sealing arrangement includes a door frame, a door panel attached to the door frame, and a gasket pressing member. The gasket pressing member has a knife edge, and is attached to the door frame. In this aspect, the invention further includes a gasket retainer attached to the door panel, the gasket retainer having a substantially rectangular channel. A wedge is attached to a back side of the door panel and a dogging structure is attached to the door frame for applying a force on the gasket via the wedge. In accordance with this invention, the gasket comprises an elongated silicone rubber member having a ridged rectangular cross-section for mounting to the gasket channel. The ridged rectangular cross-section of the gasket has a back side with a first end and a second end and a front side with a first end and a second end. The ridged cross-section also has a first side extending from the first end of the back side to the first end of the front side, and a second side extending from the second end of the back side to the second end of the front end. The ridged rectangular cross section further includes a ridged portion protruding from the front side, wherein the back side, the front side, the first side, and the second side contact the gasket channel. The ridged portion contacts the knife edge of the pressing member. In this aspect, the all purpose sealing arrangement includes an elongated crush zone within the elongated silicone rubber member formed substantially adjacent to the ridged portion of the elongated silicone rubber member. The arrangement further includes an elongated intumescent section within the elongated silicone rubber member formed substantially adjacent to the back side of the elongated silicone rubber member.

BRIEF DESCRIPTION OF DRAWINGS

A more complete appreciation of the invention and many of its attendant advantages will be readily appreciated as the same becomes better understood by reference to the following detailed description when considered in connection with the accompanying drawing wherein:

FIG. 2A is a perspective view of a general sealing arrangement in accordance with an embodiment of the present invention;

FIG. 2B is a perspective view of an all purpose sealing arrangement in accordance with an embodiment of the present invention;

DETAILED DESCRIPTION

Figure 1A:
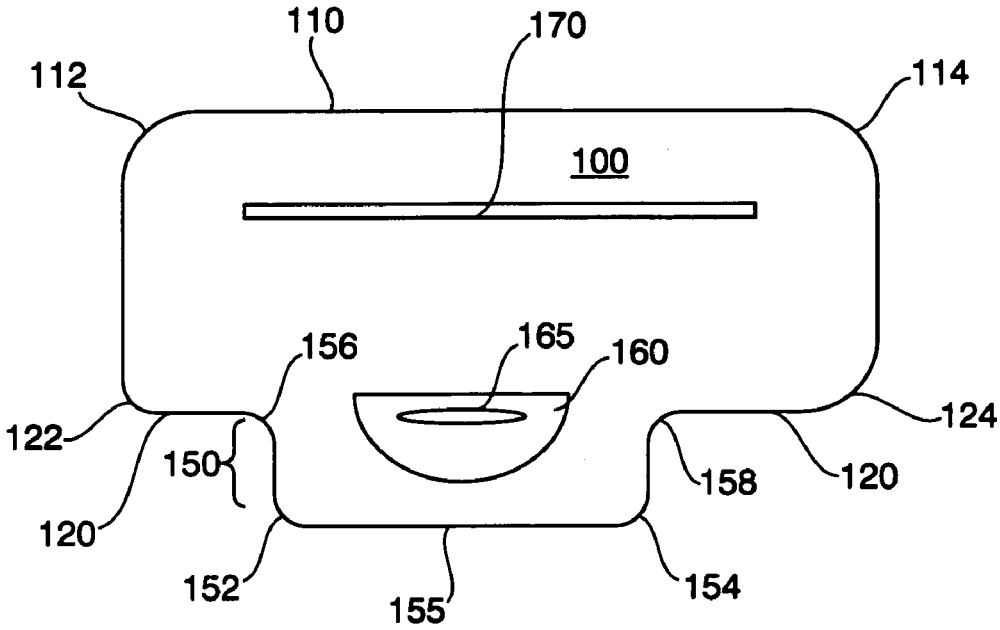
FIG. 1A is a sectional view of a gasket in accordance with an embodiment of the present invention.

FIG. 1A illustrates a sectional view of a gasket 100 in accordance with an embodiment of the present invention. The gasket is used to create an all purpose seal at a doorway that facilitates egress through bulkheads. As shown in FIG. 1A the gasket 100 has a ridged rectangular cross section. FIG. 1A also shows the gasket 100 having a back side 110 with a first end shown generally at 112 and a second end shown generally at 114. The ridged rectangular cross section of the gasket 100 further includes a front side 120 having a first end shown generally at 122 and a second end shown generally at 124.

A ridged portion 150 protrudes from the front side 120, forming a ridge-like protrusion. As shown in FIG. 1A, the ridged portion 150 protrudes from the front side 120, protruding at locations corresponding to a first corner portion 156 and at a second corner portion 158. The protrusion at the first corner portion 156 extends to a first end 152 of the ridged portion 150. The protrusion at the second corner portion 158 extends to a second end 154 of the ridged portion 150.

The gasket 100 primarily comprises silicone rubber, preferably of a Commercial Item Description A-A-59588 type. The A-A-59588 is preferably class 3B, grade 30, but may also be of other A-A-59588 silicone rubber classes and grades. The gasket 100 also includes a crush zone 160 within the silicone rubber body. The crush zone is the region immediately surrounding an air pocket 165 within the silicone rubber body. The crush zone is located adjacent to a surface 155 of the ridged portion 150. The air pocket enables the crush zone to collapse inwards in a predetermined manner to form a proper sealing relationship when placed in a gasket channel. Alternatively, the air pocket may be replaced by a material that is significantly less rigid than the surrounding silicone material, creating a crush zone around that material. This softer material would also enable a predetermined inward collapse upon the application of pressure.

The gasket 100 also includes an intumescent section 170 adjacent to the back side 110. The intumescent section 170 comprises intumescent material, which expands upon exposure to escalated temperatures. The intumescent material may comprise any known intumescent chemical, such as intercalated graphite, mica, perlite, vermiculite, hydrated sodium silicate, and phosphorus, or combinations thereof. The intumescent material may be chosen depending on the environmental conditions and the required amount of expansion. If fire-zone sealing is not required, the intumescent section 170 may be omitted.

Figure 1B:
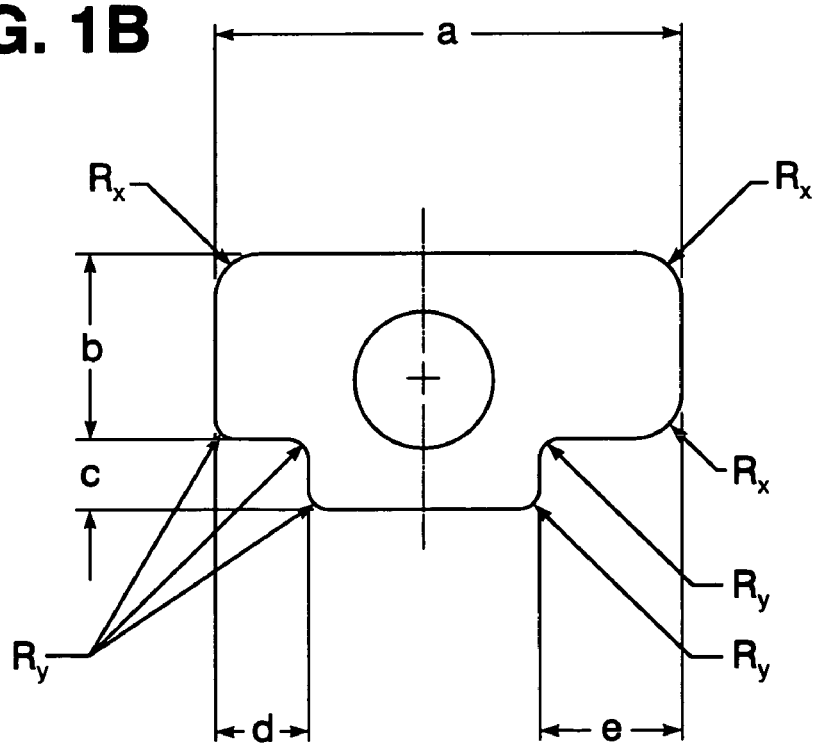
FIG. 1B is a sectional view of a gasket in accordance with an embodiment of the present invention.

FIG. 1B illustrates the gasket 100 and possible dimensions for the device. As shown in FIG. 1B, the back side 110 has a length of a. The first side 130 and the second side 140 each have a length of b. As shown in FIG. 1B, the ridged portion 150 protrudes from the front side by a distance of c. The distance from the first end 122 of the front side to the first corner portion 156 is d. The distance from the second end 124 of the front side to the second corner portion 158 is e. FIG. 1B also illustrates the first and second ends 112, 114 of the back side and the second end 124 of the front side having rounded edges, each edge having a radius of curvature of $R_x$. The first end 122 of the front side, the first and second ends 152, 154 of the ridged portion, and the first and second corner portions 156, 158 of the ridged portion, all have rounded edges with a radius of curvature of $R_y$.

Lengths, distances, and radii of curvature a, b, c, d, e, $R_x$ and $R_y$ may vary according to specific applications. According to one embodiment, the length of the back side a may be about 1.25 inches. The length b of the first and second sides 130, 140 may each be about 0.50 inches. The amount of protrusion c that the ridged portion 150 protrudes from the front side 122 may be about 0.1875 inches. The distance d from the first end of the front side 122 to the first corner portion 156 may be about 0.25 inches. The distance e from the second end of the front side 124 to the second corner portion 158 may be about 0.375 inches. According to this embodiment, the radius of curvature $R_x$ of the first and second ends may be about 0.125 inches, and the radius of curvature of the remaining rounded edges $R_y$ may be about 0.0625 inches. The dimensional measurements of this embodiment are especially suited for a particular sealing arrangement as illustrated in FIGS. 2A, 2B, and 2C.

FIG. 2A is a perspective view of an all purpose sealing arrangement 200 in accordance with an embodiment of the present invention. The all purpose sealing arrangement has a door frame 210 and a door 220 attached to the frame 210 via an attaching means 230. Preferably, the attaching means 230 is a hinge, allowing the door 220 to pivot with respect to the frame 210. The door 220 may comprise a hollow panel filled with a heat insulating material that reduces heat transfer from one side of the door panel to the other during a fire. A gasket retainer 240 with a channel is attached to the door 210 at a peripheral location around the outer circumference of the door 220. The gasket 100 is mounted within the inner walls of the gasket channel. Dogging structures 250 are provided on the frame 210 for slidably forcing the gasket 100 into the gasket channel 240.

FIG. 2B is a more detailed illustration of the all purpose sealing arrangement 200 in accordance with an embodiment of the present invention. FIG. 2B shows the door in a closed locked position. The arrangement 200 includes the door panel 222 mounted to the frame 210. As shown in FIG. 2B, the arrangement 200 includes bearings 215 for providing movement between elements. A wedge 265 is mounted at the back of the door panel 222. FIG. 2B shows dogs 255 of the dogging structure 250, pushing down on the wedge 265. The gasket retainer 240 is mounted to the door panel 222, with the gasket 100 mounted within the inner walls of the gasket channel of the retainer. A knife edge 275 of a pressing member 270 presses against the gasket 100. In the all purpose sealing arrangement, the dogging structure 250 and the knife edge 275 apply forces in substantially opposite directions, sandwiching the gasket 100, the door panel 222, and the wedge 265.

Figure 2C:
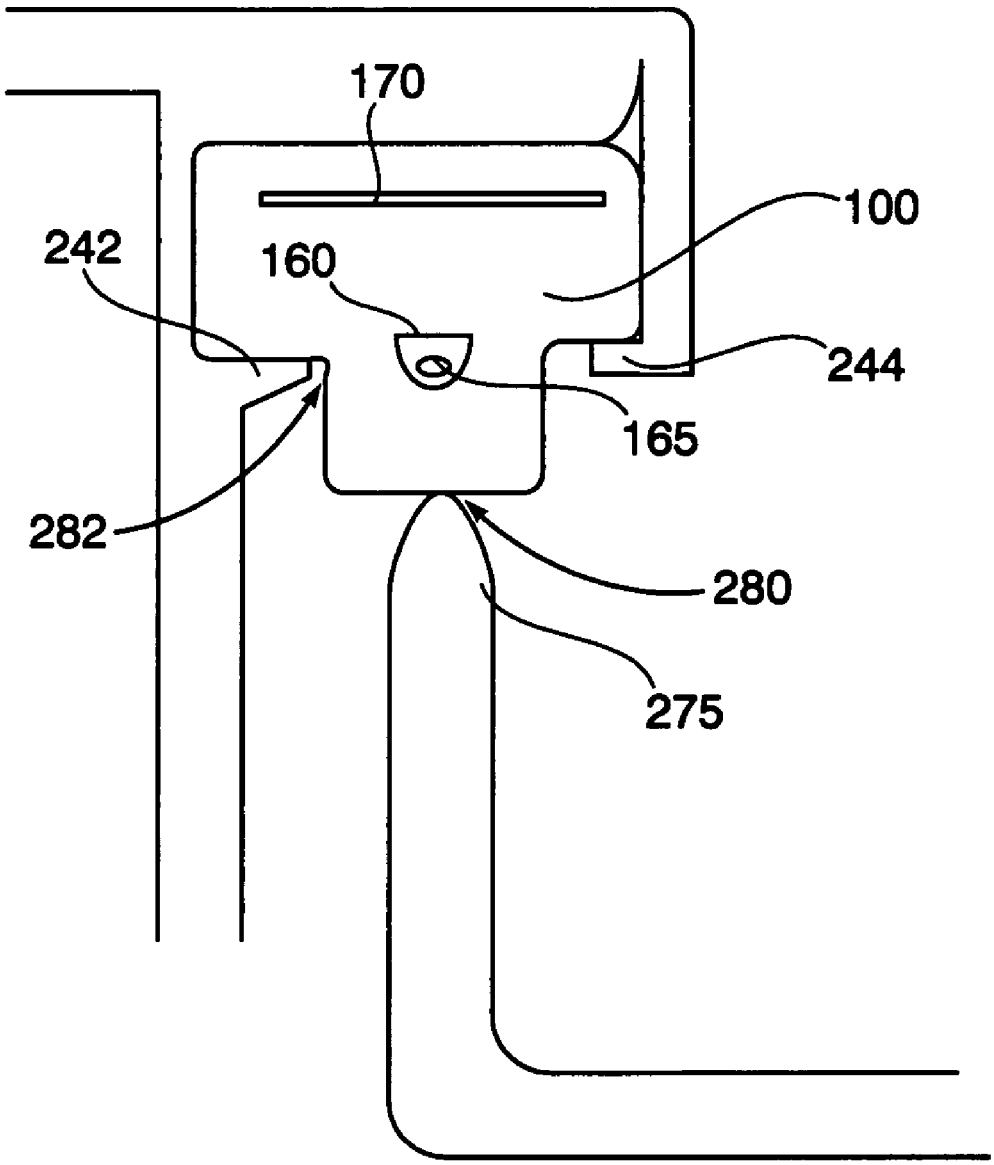
FIG. 2C is a perspective enlarged view of the all purpose sealing arrangement illustrated in FIG. 2B.

FIG. 2C is a perspective enlarged view of the all purpose sealing arrangement illustrated in FIG. 2B. The enlarged view shows the gasket retainer 240 having a channel, with the gasket 100 mating with the walls of the channel. As shown, the gasket retainer 240 includes a first hook portion 242 and a second hook portion 244 which mates with first and second portions of the front side of the gasket 100. The first and second hook portions may have length substantially equal to the first and second portions of the front side, respectively. The ridged portion 150 of the gasket protrudes between an opening formed between the first and second hook portions 242 and 244. In the sealed arrangement, the knife edge 275 of the pressing member 270 presses against the surface 155 of the ridged portion 150.

FIG. 2C shows water intrusion paths generally at 280 and 282. In order to provide complete water integrity, both water intrusion paths must be blocked. The water intrusion path 280 may be formed where the knife edge contacts the gasket. The water intrusion path shown generally at 282 may be formed at the points of contact where the gasket contacts the gasket channel. When the knife edge 275 contacts the gasket 100, a force that is substantially normal to the surface 155 compresses the gasket. The existence of the air pocket 165 and surrounding crush zone 160 allows the gasket to collapse inwards. This creates a strong seal between the knife edge and the gasket blocking the water intrusion path 270. The internal collapse of the gasket 100 due to the crush zone 165 also pushes the gasket against the inner walls of the channel, creating a proper seal and blocking water intrusion path 282. If the gasket were not designed to collapse inwards, the force created by the knife edge would pull the corners of the gasket away from the walls of the channel. Therefore, the gasket designed with the ridged rectangular shape and crush zone allows for a watertight seal.

FIGS. 1A and 2C show the intumescent portion 170. If the gasket 100 is exposed to fire for a prolonged period, silicone rubber may eventually char, exposing the intumescent portion 170 to high temperatures and/or direct fire. The temperatures may be from about 1,500 degrees Fahrenheit to 2,000 degrees Fahrenheit and above. The inherent properties of the intumescent inner core will result in the expansion of about twenty to forty times its original volume. This voluminous expansion of the intumescent portion will fill up any voids left by the deterioration of the silicone rubber, retaining the fire-tight and smoke-tight seal.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A gasket comprising:

an elongated silicone rubber member having a ridged rectangular cross-section for mounting to a gasket retainer and a door frame, the ridged rectangular cross-section comprising:

a back side with a first end and a second end;

a front side with a first end and a second end;

a first side extending from the first end of the back side to the first end of the front side;

a second side extending from the second end of the back side to the second end of the front end; and a ridged portion protruding from the front side, wherein the back side, the front side, the first side, and the second side are for contacting inner walls of the gasket retainer, and the ridged portion is for contacting a knife edge of the door frame; and an elongated crush zone within the elongated silicone rubber member formed substantially adjacent to a surface of the ridged portion of the elongated silicone rubber member; and wherein the gasket further comprises an elongated intumescent section within the elongated silicone rubber member formed substantially adjacent to the back side of the elongated silicone rubber member.

2. The gasket of claim 1, wherein the crush zone comprises an air pocket and portions of the silicone rubber immediately surrounding the air pocket, wherein the crush zone collapses inwards when the knife edge directs a force substantially normal to the surface of the ridged portion of the gasket.

3. The gasket of claim 2, wherein in the ridged rectangular cross section, the back side is about 1.25 inches long, the first and second sides are each about 0.50 inches long, and wherein the ridged portion protrudes a distance of about 0.1875 inches from the second side.

4. The gasket of claim 2, wherein the silicone rubber is selected from a class in accordance with Commercial Item Description A-A-59588, Class 3B Grade 30.

5. The gasket of claim 2, wherein in the ridged rectangular cross section, the ridged portion comprises:

a first end;

a second end;

a first corner portion; and a second corner portion, wherein each of the first and second ends of the back side, the first and second ends of the front side, the first and second ends of the ridged portion, and the first and second corner portions, have a rounded design.

6. The gasket of claim 5, wherein the first corner portion of the ridged portion is a distance of about 0.25 inches from the first end of the front side, and the second corner portion of the ridged portion is a distance of about 0.375 inches from the second side of the front side.

7. An all-purpose sealing arrangement having:

a door frame;

a door panel attached to the door frame;

a gasket pressing member having a knife edge, the gasket pressing member attached to the door frame;

a gasket retainer attached to the door panel, the gasket retainer having a substantially rectangular channel;

a wedge attached to a back side of the door panel;

a dogging structure attached to the door frame for applying a force on the gasket via the wedge;

a gasket comprising an elongated silicone rubber member having a ridged rectangular cross-section for mounting to the gasket channel, the ridged rectangular cross-section comprising:

a back side with a first end and a second end;

a front side with a first end and a second end;

a first side extending from the first end of the back side to the first end of the front side;

a second side extending from the second end of the back side to the second end of the front end; and a ridged portion protruding from the front side, wherein the back side, the front side, the first side, and the second side contact the gasket channel, and the ridged portion contacts the knife edge of the pressing member;

an elongated crush zone within the elongated silicone rubber member formed substantially adjacent to the ridged portion of the elongated silicone rubber member; and an elongated intumescent section within the elongated silicone rubber member formed substantially adjacent to the back side of the elongated silicone rubber member.

8. The all purpose sealing arrangement of claim 7, wherein the crush zone comprises an air pocket and portions of the silicone rubber immediately surrounding the air pocket, wherein when the knife edge of the pushing member contacts the ridged portion applying a force substantially normal to the surface of the ridged portion of the gasket, the crush zone collapses inwards to block water intrusion paths.

9. The all purpose sealing arrangement of claim 8, wherein the silicone rubber is selected from a class in accordance with Commercial Item Description A-A-59588, Class 3B Grade 30.

10. The all purpose sealing arrangement of claim 9, wherein in the ridged rectangular cross section, the back side is about 1.25 inches long, the first and second sides are each about 0.50 inches long, and wherein the ridged portion protrudes a distance of about 0.1875 inches from the second side.

11. The all purpose sealing arrangement of claim 10, wherein in the ridged rectangular cross section, the ridged portion comprises:

a first end;

a second end;

a first corner portion; and a second corner portion, and wherein each of the first and second ends of the back side, the first and second ends of the front side, the first and second ends of the ridged portion, and the first and second corner portions, have a rounded design.

12. The all purpose sealing arrangement of claim 11, wherein the first corner portion of the ridged portion is a distance of about 0.25 inches from the first end of the front side, and the second corner portion of the ridged portion is a distance of about 0.375 inches from the second side of the front side.

13. The all purpose sealing arrangement of claim 12, wherein the gasket retainer includes:

a first hook member contacting a first portion of the front side of the gasket; and a second hook member contacting a second portion of the front side of the gasket, the second hook member being longer than the first hook member to correspond to the shape of the gasket.

14. The all purpose sealing arrangement of claim 13, wherein the first hook member is about 0.25 inches long, and the second hook member is about 0.375 inches long.

15. The all purpose sealing arrangement of claim 7, wherein the intumescent section comprises a material selected from the group comprising graphite, mica, perlite, vermiculite, hydrated sodium silicate, phosphorus, and combinations thereof to allow for an expansion of up to 40 times the original volume of the intumescent section if the intumescent section is exposed when the silicone rubber undergoes fire damage.

* * * * *